US007125350B1

(12) United States Patent
Reason-Kerkhoff

(10) Patent No.: US 7,125,350 B1
(45) Date of Patent: Oct. 24, 2006

(54) SWING TRAINING DEVICE FOR SPORTS

(76) Inventor: Debra R. Reason-Kerkhoff, 1744 Sparkling Water Cir., Ocoee, FL (US) 34761

( * ) Notice: Subject to any disclaimer, the term of this patent is extended or adjusted under 35 U.S.C. 154(b) by 0 days.

(21) Appl. No.: 11/182,353

(22) Filed: Jul. 15, 2005

Related U.S. Application Data

(60) Provisional application No. 60/679,616, filed on May 10, 2005, provisional application No. 60/671,608, filed on Apr. 15, 2005.

(51) Int. Cl.
*A63B 69/00* (2006.01)

(52) U.S. Cl. ..... 473/452

(58) Field of Classification Search ..... 473/452, 473/272, 270, 217, 269
See application file for complete search history.

(56) References Cited

U.S. PATENT DOCUMENTS

| | | | | |
|---|---|---|---|---|
| 2,189,613 | A * | 2/1940 | Paulsen | 473/270 |
| 3,352,559 | A * | 11/1967 | Larsen | 473/269 |
| 3,372,930 | A * | 3/1968 | Sertich | 473/452 |
| 3,466,040 | A * | 9/1969 | Sertich | 473/452 |
| 3,979,116 | A | 9/1976 | Matchick | |
| 4,194,735 | A | 3/1980 | Wilson | |
| 4,629,181 | A * | 12/1986 | Krive | 482/71 |
| 4,932,656 | A | 6/1990 | Pierce | |
| 5,037,094 | A | 8/1991 | Johnson | |
| 5,318,290 | A * | 6/1994 | Sawyer | 473/217 |
| 5,810,673 | A * | 9/1998 | Castleberry | 473/217 |
| 5,976,026 | A * | 11/1999 | Erb | 473/272 |
| 6,102,818 | A | 8/2000 | Hamilton | |
| 6,723,004 | B1 * | 4/2004 | Florian | 473/270 |
| 6,749,529 | B1 * | 6/2004 | Sobolewski | 473/451 |

OTHER PUBLICATIONS

Item TAH49 from on-line catalog www.baseballjunk.com/hittingaids.htm called "Stride Guide", photo and features list.
Item TAH35 from on-line catalog www.baseballjunk.com/hittingaids.htm called "Pivot Pro", photo and brief description.
Item TAH55 from on-line catalog www.baseballjunk.com/hittingaids.htm called "Dewstep", photo and brief description.

* cited by examiner

*Primary Examiner*—Eugene Kim
*Assistant Examiner*—M. Chambers
(74) *Attorney, Agent, or Firm*—David G. Maire; Beusse Wolter Sanks Mora & Maire, P.A.

(57) ABSTRACT

A device for practicing an address stance and ball-hitting motion in a sport such as softball. A batter stands on a step plate (30) and a swivel plate (31) mounted on a flat base (12). The plates have adjustable separation, and align the user's feet using toe stops (36). The step plate (30) has foot guards (34) that force the user to step towards the pitch. The swivel plate (31) rotates about a vertical axis, and has foot-retaining straps (38, 39) that allow the heel to lift. Swivel stops (18, 20) limit the rotation range between address alignment and a safe maximum swivel. The user learns to step toward the pitch and swivel the back foot while swinging the bat, turning the body, and shifting weight toward the pitch. The foot plates (30, 31) are reversible on the base (12) for right or left-handed use.

9 Claims, 4 Drawing Sheets

SWING TRAINING DEVICE FOR SPORTS

CROSS REFERENCE TO RELATED APPLICATIONS

This application claims the benefit of U.S. provisional application 60/671608, filed Apr. 15, 2005 and U.S. provisional application 60/679,616, filed May 10, 2005

FIELD OF THE INVENTION

This invention relates to the field of training aids for batting a ball, and especially to devices for training the foot positions and body movements for batting a ball such as a baseball or softball.

BACKGROUND OF THE INVENTION

Numerous bat swing training aids have been devised for softball and baseball. Some of these include plates or mats placed on the ground beside a home plate, with foot placement indications for an address stance and swing stride. These aids vary in emphasis, mode of enforcement, intended result, safety, and other factors. However, none of them combines an ideal training result with safety, convenience, and practicality in the same way and to the same degree as the present invention.

For example, a product called "stride guide" is a flat plate with foot placement and stride indicators and a rotating disk for the ball of the back foot. It has a raised edge behind the disk to enforce lifting of the back heel, thus shifting the user's weight forward. It has other raised edges to limit the stride of the lead foot. However, it does not require the user to step with the lead foot, rather than slide, it does not physically set both feet in toe alignment for the address stance, it does not physically align the lead foot perpendicularly to the pitch, it does not physically set the address stance width, it does not retain the back foot, and it does not limit the pivot range of the back foot.

The present inventor feels that physical enforcement of address stance and stepping into the swing provides more definitive training and faster coaching than visual indicators alone, and that these physical enforcements make a stronger impression on a user's "muscle memory". She also feels that physical limits on the back foot pivot range are important, both for training and safety.

BRIEF DESCRIPTION OF THE DRAWINGS

The invention is explained in following description in view of the drawings that show.

DETAILED DESCRIPTION OF THE INVENTION

The inventor recognized that a better training aid would be useful in instructing softball and baseball users during batting practice to align their feet in the address stance, to avoid putting their feet too far apart, to lift the back heel, and to step toward the pitcher and shift their weight while swinging the bat. She devised a convenient and practical device for this purpose. In this description "front" or "forward" means toward the ball pitcher, "back" means away from the ball pitcher. Gender-specific pronouns are used for convenience only, and are intended to include both genders.

Figure 5:
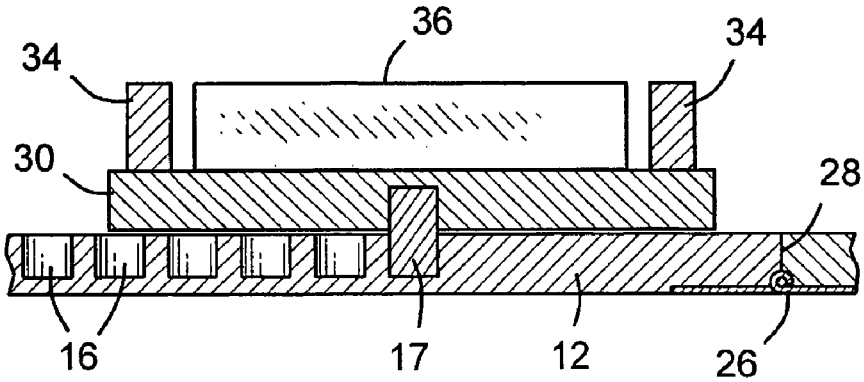
FIG. 5 is a sectional view taken along section line 5—5 of FIG. 3.
Figure 6:
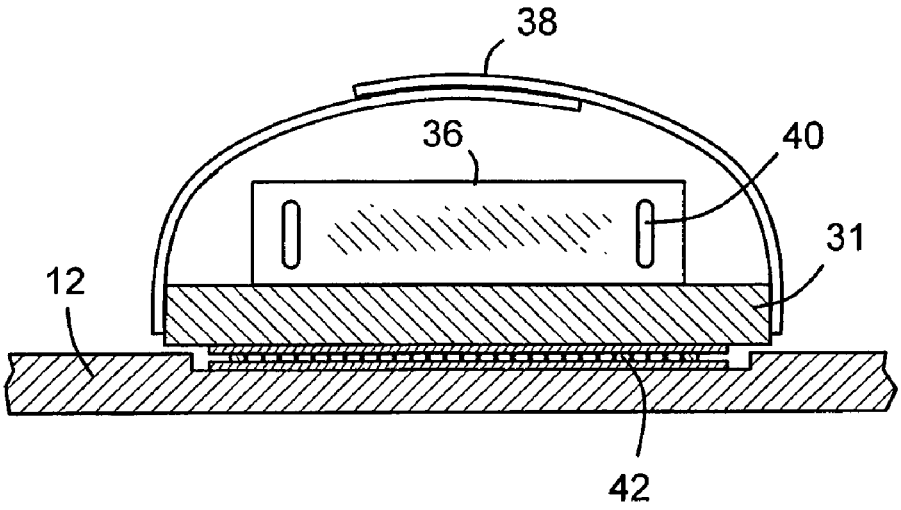
FIG. 6 is a sectional view taken along section line 6—6 of FIG. 3.

The drawings illustrate an embodiment of a device for training the foot positions and body motions for batting a ball such as a baseball during the address stance, swing, and follow-through. It teaches proper foot orientation and stance width, swing stride, shifting of body weight, and proper back foot pivot. It comprises a base plate 12 with anchor holes 14 for ground anchors 15. A step plate 30 for the lead foot comprises a traction surface 32, a raised toe stop 36, and two raised foot guards 34. The step plate 30 is mounted to the base plate 12 at a selectable position provided by pegs 17 in alternate peg holes 16 as seen in FIG. 5. A swivel plate 31 for the back foot comprises a traction surface 32, a raised toe stop 36, and foot restraint straps 38, 39 arranged to hold the ball on the foot on the plate while allowing the heel to lift. The swivel plate 31 is mounted on the base plate 12 by a bearing 42 that allows rotation of the swivel plate 31 about a vertical axis. The bearing 42 may be recessed in the base plate 12 as in FIG. 6 so that the top surfaces of the step plate 30 and the swivel plate 31 are at approximately the same height. As an example of bearing 42 a ring of ball bearings captured between two race plates can be used. The base plate 12 may be divided in half along a hinge line 28 connected by a hinge 26 for compact folding. It may further comprise a handle 29 on each half for convenient carrying of the folded device. The handles 29 may be on the ends of the base plate 12, as shown, or on other parts of the edge.

Figures 1, 2:
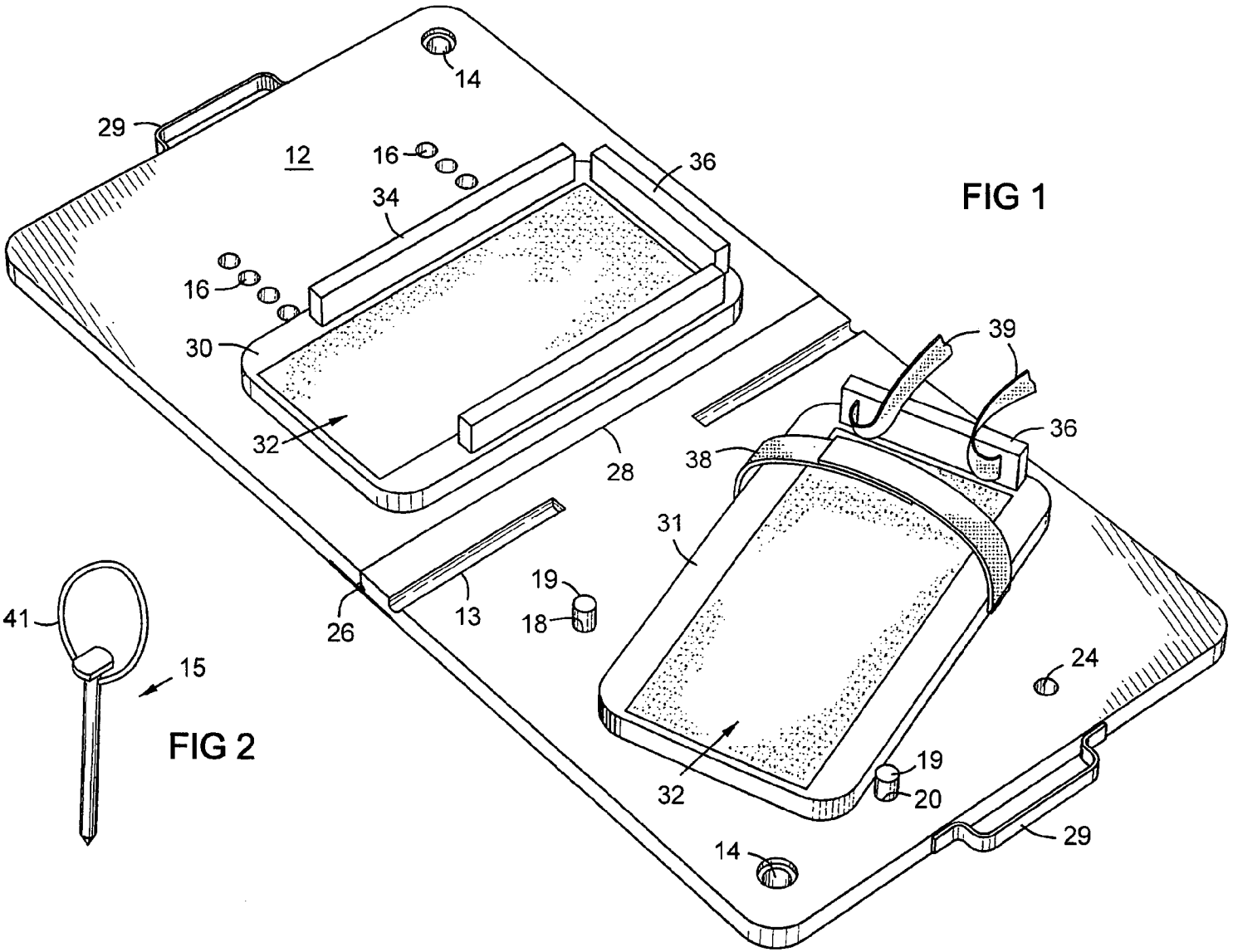
FIG. 1 is a perspective view of an embodiment of the invention
FIG. 2 is a perspective view of a ground anchor
Figure 3:
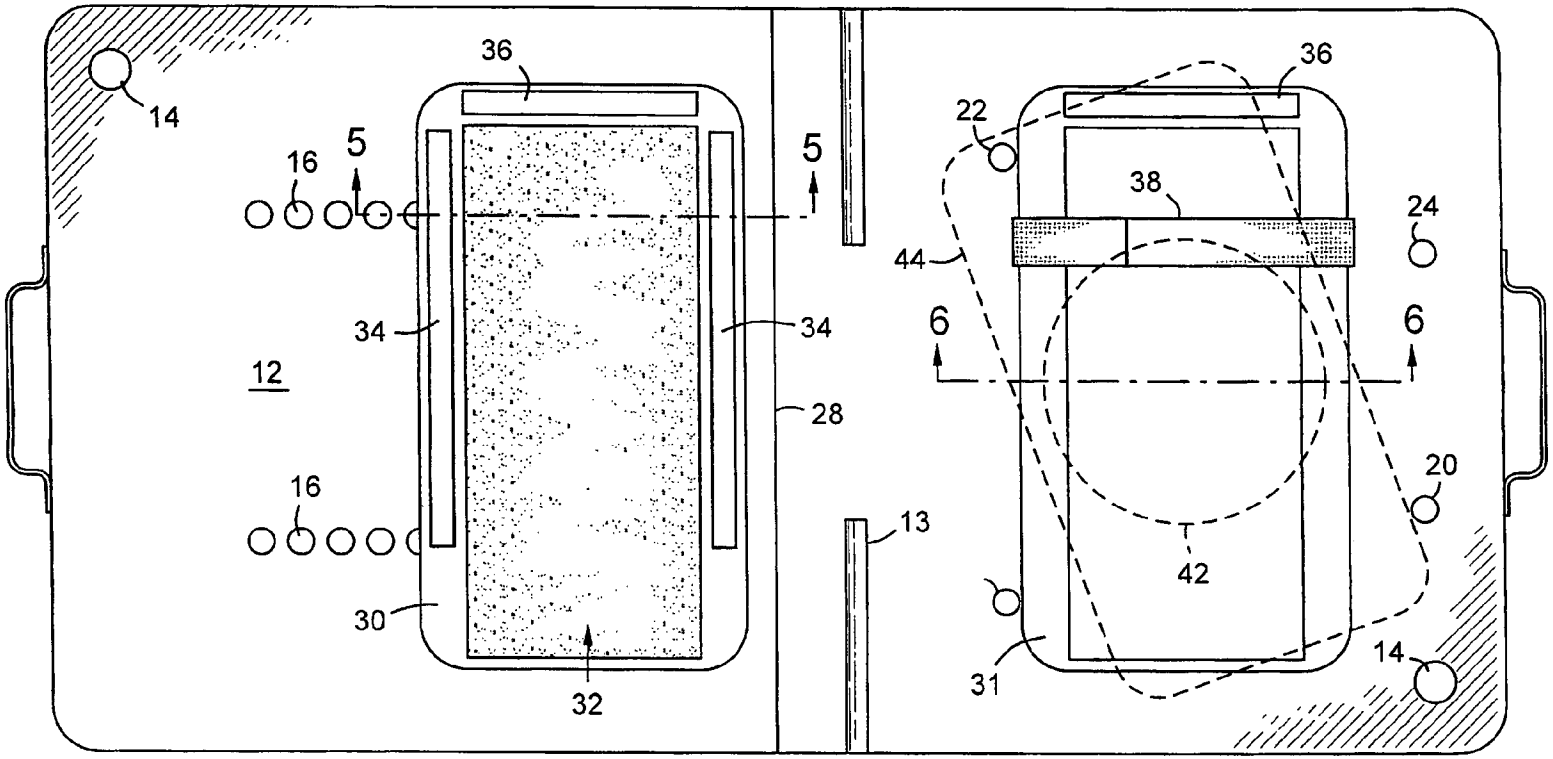
FIG. 3 is a top view of the embodiment of FIG. 1.

FIGS. 1 and 3 show a swiveled position 44 of the swivel plate 31 that occurs during a batter's swing. The swivel range is limited by swivel stops 18, 20, 22, 24 in the base plate. This prevents excess swiveling that overshoots the desired running position and could injure a user's ankle or knee. Two stop pegs 19 are inserted in a selected two of the stop holes 18, 20, 22, 24 depending on right or left-handed use. For a right-handed batter, swivel stop holes 18 and 20 are pegged. The peg in hole 18 stops the swivel plate 31 in alignment with the step plate 30 for the address stance. The peg in hole 20 stops the swivel during the swing. Swivel stop 20 provides a predetermined swivel angle such as 40 degrees. Optionally, a series of stop holes 20 (not shown) or another adjustable stop means (not shown) can be provided so the user can select a swivel angle within a range such as 20–90 degrees, for both hitting and bunting practice.

The step plate 30 is adjustably mounted so users know where and how to begin their address stance. This prevents them from starting with their feet too far apart. A series of stance width adjustment holes 16 may be provided on the base plate 12. The step plate 30 may have a bottom surface with mounting pegs 17 extending downward for insertion into selected adjustment holes 16 as in FIG. 5. This allows the step plate 30 to be mounted on the base plate in a position that provides a natural stance for the user, such as approximately shoulder width apart from the swivel plate 31.

Figure 7:
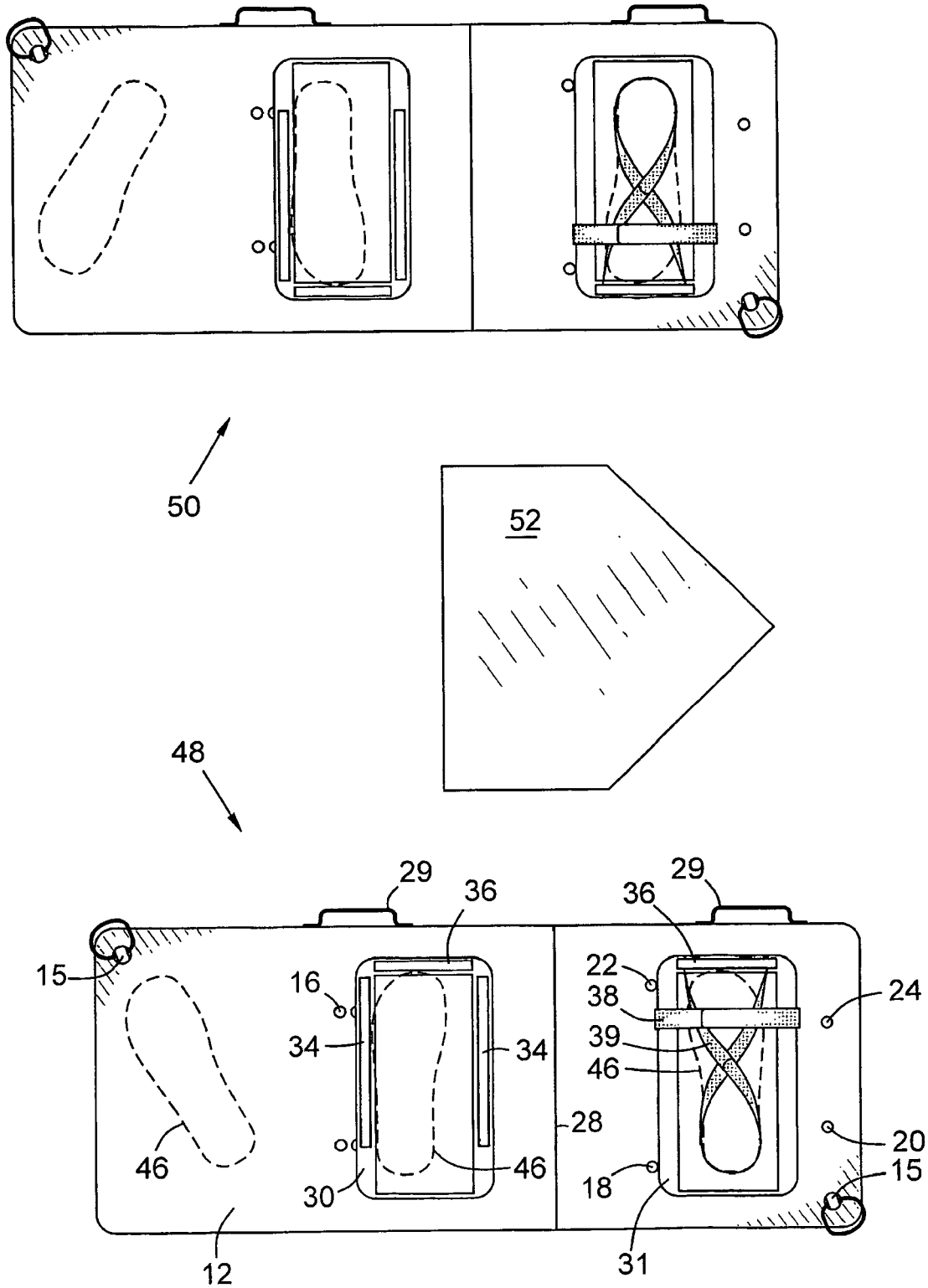
FIG. 7 is a top view of left and right-handed configurations of the device relative to a home plate, with an extended lead portion of base.

The length of the baseplate(s) may be any selected length, with both halves being of equal or of unequal length as measured from the hinges. FIG. 7 shows a version of this device with a base 12 with one half that is larger in the forward direction. This extension provides extra space upon which the lead foot can step during the swing, as shown by footprints 46. The base may be asymmetric about the hinge 28, as shown in FIG. 7. Two handles 29 can be provided as shown that are equidistant from the hinge-line 28 at approximately a balance point when the base is folded. This brings the handles together in the folded position of the base for easy carrying, so that a latch is not needed to maintain the folded position. FIG. 7 shows a right-handed configuration 48 and left-handed configuration 50 of the device relative to a home plate 52.

To use this device a user puts her back foot, which is the foot furthest from the pitcher into the swivel plate 31 up to the toe stop 36. Then she adjusts the toe strap 38 across the foot, and adjusts the ankle strap 39 over the foot and around the ankle. This retains the foot on the swivel plate 31 while allowing the heel to rise during the swing. The user puts her lead foot on the step plate 30 with her toe against the toe stop 36 and the leading side of the foot against a foot guard 34. The user is now standing on the two plates with her feet aligned with each other as shown by footprints 46 of FIG. 7.

The user takes an address stance for swinging a bat at a pitched ball. The user steps forward towards the pitch, shifts body weight toward the pitch, lifts the back heel, and twists hips and shoulders toward the pitch, causing the swivel plate 31 to turn to its stop. Proper foot alignment is taught by placing one foot on the stepping plate 30 and one foot on the swivel plate 31. The user places each foot forward to the respective toe stop 36. This teaches the user to align the feet evenly. The front foot is placed against the forward-most foot guard so the foot is perpendicular to the pitch. The user's back foot is strapped on to the swivel plate with a toe strap across the toe area and an ankle strap around the ankle. The proper address stance width is important so the user does not overstep the swing. Stance width is set by adjusting the stepping plate 31 to the natural stance of the user by mounting the stepping plate pegs 17 in a selected pair of holes 16.

Once the user has proper placement of her feet on the stepping plate 30 and the swivel plate 31, she is ready to begin her swing. The user will step over the foot guard 34 on the stepping plate 30, causing her weight to shift forward toward the ball. This will happen naturally when she steps, since the base plate 12 is lower than the stepping plate. It is important for the user to learn to step forward and not to slide the front foot forward, in order to ensure proper weight shift to the front leg. The foot guard 34 requires the user to lift the front foot a predetermined distance to clear the foot guard 34, thus training the user not to slide the foot. The base can be made long enough to receive the lead foot after it steps forward off of the stepping plate. The user's back foot stays against the toe stop 36. The heel of the back foot is raised, shifting weight to the ball of the foot as the user turns the foot and the swivel plate 31.

This device is designed for practical manufacture. All plates 12, 30, and 31 can be fabricated from standard flat stock material using conventional machine tools or woodworking tools and methods, or they can be molded or otherwise formed. The step plate 30 and the swivel plate 31 can be formed in the same mold, including foot guards 34 on both plates, to reduce tooling cost. The materials for the construction of the various structural members of the device may be plastic, wood, metal, fiberglass, or other material having the required strength and preferably lightweight for easy portability. The peg holes 16, 18, 20, 22, 24 in the base plate may be lined with sleeves (not shown) to enable the pegs to be removed and replaced repeatedly without damaging the base plate 12.

Figure 4:
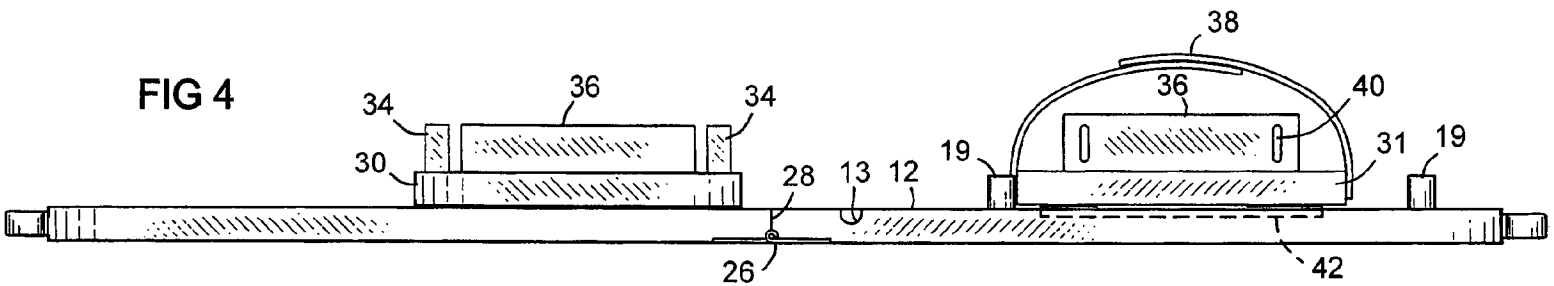
FIG. 4 is a side view of the embodiment of FIG. 1.

Holders for the anchors 15 may be provided on the base plate 12. For example, depressions 13 can be provided in the base 12 as shown in FIGS. 1, 3, and 4 to frictionally grip and hold the anchors in a stored position. Spring clips or other known holders can also be used. The anchors may have loops 41 as shown in FIG. 2 for easy manual pulling of the anchors from the ground. In this case, the anchors can be stored on the toe strap 38, without need for other holders.

The step plate 30 has two lateral adjustment pegs 17 on the bottom, a non-skid upper surface 32, a toe stop 36, and a raised foot guard 34 on each side. One foot guard 34 is used for right-handed hitters and the other is used for left-handed hitters. To convert between right and left-handed hitters the step plate 30 is lifted from the base 12, rotated 180 degrees, and reset in the adjustment holes 16.

The swivel plate 31 has a toe stop 31 with holes 40 for attaching the ankle strap 39. The toe strap 38 can be attached to the swivel plate as shown. Optionally two foot guards 34 can be provided on the swivel plate 31 as on the step plate 30 to prevent the back foot from slipping off the swivel plate 31. In this case, the toe strap 38 can be attached to the foot guards. To convert the swivel plate 31 between right-handed and left-handed hitters, the stop pegs 19 are removed, and the swivel plate is rotated 180 degrees, then the stop pegs 19 are placed into stop holes 18 and 20 for right-handed hitters or holes 22 and 24 for left-hand hitters. Optionally, the stop pegs 19 may be provided in the form of captured spring-loaded buttons in all of the stop holes 18, 20, 22, 24, that toggle between an extended and retracted position.

The toe and ankle straps 38, 39 may be made of leather, fabric, plastic, or other appropriate material. The two ends of each strap should have the capability of being joined together and loosened to facilitate insertion and removal of the foot. The clasp for the straps may be a buckle, VELCRO brand fastener, cinch strap with ring, quick release buckle or simply a tie or some other appropriate clasp. The ankle strap 39 may or may not be crossed over the top of the foot.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A swing training device comprising:

a base;

a swivel plate rotatably attached to the base, comprising a foot positioning structure for positioning a user's back foot in an address position, the swivel plate rotatable relative to the base as the user's back foot is moved from the address position to a swinging position;

a step plate removably attachable to the base in any of a plurality of positions relative to the swivel plate in response to a size of the user, the step plate comprising a foot positioning structure for positioning the user's front foot in an address; and the front foot positioning structure comprising a foot guard comprising a height over which the user must lift the front foot to move the front foot from the address position to a swinging position;

the foot positioning structure of the step plate further comprises a toe end with a first toe stop;

the foot positioning structure of the swivel plate further comprises a toe end with a second toe stop;

and further comprising:

a first swivel plate stop that stops rotation of the swivel plate in a first angular direction at the address position in which the swivel plate is in substantial alignment with the step plate; and a second swivel plate stop that stops rotation of the swivel plate in a second angular direction at the swinging position in which the toe end of the swivel plate is angled toward the step plate.

2. The swing training device of claim 1, wherein the swivel plate is reversible 180 degrees to convert the swing training device between right and left-handed use; the step plate is reversible 180 degrees to convert the swing training device between right and left-handed use; and further comprising third and fourth swivel plate stops that act similarly to the respective first and second swivel plate stops in a 180-degree reversed position of the swivel plate.

3. The swing training device of claim 2, wherein the base is divided into two parts along a transverse hinge line approximately midway along a length of the base, the two parts of the base connected by a hinge for folding of the swing training device; and further comprising at least one handle on a periphery of the base.

4. A method of using the swing training device of claim 1 by the user comprising:

positioning the swivel plate in the address position;

adjusting the distance of the step plate from the swivel plate to a desired address stance for the size of the user;

the user placing the front foot in the step plate with a toe end of the front foot against the step plate toe stop;

the user placing the back foot in the swivel plate with a toe end of the back foot against the swivel plate toe stop;

the user swinging a ball striking implement while stepping forward off the step plate with the front foot, and pivoting the swivel plate to the swinging position with the back foot.

5. A swing training device comprising:

a base comprising a length and front and back portions;

a swivel plate mounted to rotate about a first substantially vertical axis on the back portion of the base;

a step plate mounted on the front portion of the base at a selectable distance from the swivel plate;

the step plate having an upper surface that is elongated in general proportion to a human foot transverse to the length of the base, and having a toe end with a toe stop;

the swivel plate having an upper surface elongated in general proportion to a human foot, and having a toe end with a toe stop;

a first swivel plate stop that stops rotation of the swivel plate in a first angular direction at an address position in which the swivel plate is in substantial alignment with the step plate;

a second swivel plate stop that stops rotation of the swivel plate in a second angular direction at a swinging position in which the toe end of the swivel plate is angled toward the step plate; further comprising:

a foot retainer on the swivel plate that allows the heel of a user's foot on the swivel plate to rise, comprising an adjustable ankle strap attached to the toe end of the swivel plate, and an adjustable toe strap attached to the swivel plate; and a foot guard on the step plate that requires the user's foot on the step plate to step over the foot guard when moving off of the step plate in a direction away from the swivel plate.

6. The swing training device of claim 5, wherein the swivel plate is reversible 180 degrees about the first vertical axis to convert the swing training device between right and left-handed use; the step plate is reversible 180 degrees about a second vertical axis to convert the swing training device between right and left-handed use; and further comprising third and fourth swivel plate stops that act similarly to the respective first and second swivel plate stops in a 180-degree reversed position of the swivel plate.

7. The swing training device of claim 6, wherein the base is divided into two parts along a transverse hinge line approximately midway along the length of the base, the two parts of the base connected by a hinge for folding of the swing training device; and further comprising at least one handle on a periphery of the base.

8. The swing training device of claim 5, further comprising at least two ground anchors.

9. A method of using the swing training device of claim 5 for a user of a given size comprising:

positioning the swivel plate in the address position;

adjusting the distance of the step plate from the swivel plate to a desired address stance for the size of the user;

the user placing a front foot in the step plate with a toe end of the front foot against the step plate toe stop;

the user placing a back foot in the swivel plate with a toe end of the back foot against the swivel plate toe stop;

the user swinging a ball striking implement while stepping forward off the step plate with the front foot, and pivoting the swivel plate to the swinging position with the back foot.

* * * * *